US007494384B2

(12) United States Patent
Friedhof

(10) Patent No.: US 7,494,384 B2
(45) Date of Patent: Feb. 24, 2009

(54) MODULAR INTERCONNECT SYSTEM AND APPARATUS

(75) Inventor: James Friedhof, Hemet, CA (US)

(73) Assignee: Deutsch Engineered Connecting Devices, Inc., Hemet, CA (US)

( * ) Notice: Subject to any disclaimer, the term of this patent is extended or adjusted under 35 U.S.C. 154(b) by 0 days.

(21) Appl. No.: 11/786,265

(22) Filed: Apr. 10, 2007

(65) Prior Publication Data

US 2008/0254665 A1 Oct. 16, 2008

(51) Int. Cl.
*H01R 13/502* (2006.01)

(52) U.S. Cl. ..... 439/701; 439/472; 439/610

(58) Field of Classification Search ..... 439/701, 439/540.1, 610, 717, 676, 472
See application file for complete search history.

(56) References Cited

U.S. PATENT DOCUMENTS 3,622,952 A * 11/1971 Hilbert ..... 439/610
3,829,821 A 8/1974 Derr et al.
3,993,394 A 11/1976 Cooper
4,715,827 A * 12/1987 Furman ..... 439/465
4,735,583 A 4/1988 Rudy, Jr. et al.
4,898,549 A 2/1990 Nakama et al.
5,195,909 A * 3/1993 Huss et al. ..... 439/465
5,348,482 A 9/1994 Rudy, Jr. et al.
5,401,177 A * 3/1995 Dutton et al. ..... 439/98
7,331,823 B2 * 2/2008 Fukushima et al. ..... 439/610
2006/0189185 A1 8/2006 Bernhart et al.

* cited by examiner

*Primary Examiner*—Neil Abrams
*Assistant Examiner*—Phuong Nguyen
(74) *Attorney, Agent, or Firm*—O'Melveny & Myers LLP

(57) ABSTRACT

Systems and apparatuses are provided for placing interconnects or connector modules into stacked arrangements, wherein individual interconnects or connector modules can be readily accessed and repaired without disrupting the stacked arrangement. In one embodiment, the electrical connector system has a plurality of interconnects mounted together in a stacked arrangement. Each of the interconnects comprises a connector body and a backshell removably coupled to the connector body, wherein the backshell is configured to receive and retain a overbraid. Each backshell is designed to be uncoupled from the connector body while retaining the plurality of interconnects in the stacked arrangement, thereby making is possible to repair single a interconnect without disrupting the others.

34 Claims, 3 Drawing Sheets

MODULAR INTERCONNECT SYSTEM AND APPARATUS

BACKGROUND OF THE INVENTION

1. Field of the Invention

The present invention is directed towards connection systems for communicating electrical signals, and more particularly, to systems and apparatuses with stacked arrangements of interconnects that can be easily accessed and repaired.

2. Description of Related Art

With the increasing demand and complexity of modern electronic systems in high reliability applications such as military and aerospace, there is a continuing need to incorporate electronic equipment into a confined space while ensuring reliability in harsh environments. In such applications, connection systems provide a critical communication link between physically separated electronic devices. These connection systems have to satisfy many competing requirements. They should be capable of withstanding a rugged environment that includes vibration, wide temperature swings, moisture, and exposure to hazardous materials and chemical contaminants. Components of the connection systems should also be both compact and easily accessible to permit repair or replacement of damaged components while limiting disruption or removal of other undamaged components.

Such connection systems typically frequently utilize connector devices or interconnects that interface with the leading ends of cables, overbraids, or the like. Such interconnects typically comprise pins or connectors on a first end, as well as a backshell on a second end for interfacing with the overbraids or the like. While such interconnects are designed to withstand rugged environments, some inevitably become damaged or non-functional during operation, and need to repaired or replaced. Design demands of electronics systems often require that the components of a system fit into a compact space. As such, interconnects are frequently placed into close proximity with each other, and are often stacked relative to each other. Such interconnects are frequently modular in design, and frequently are placed into stacked arrangements.

Placing interconnects into a stacked arrangement, however, makes it difficult to access and repair any one of the interconnects, particularly when the damaged interconnect is located in the middle or toward the bottom of the stack. As such, stacked interconnects are typically disassembled in order to access the particular interconnects that require repair or need to be replaced. This increases the number of parts that need to removed from the system, which in turn increases the amount of time needed to reassemble the system, thereby increasing the time and costs associated with repairing such systems.

Accordingly, it would be desirable to provide a connection system with stacked components, such as interconnects or the like, that can be more easily accessed and repaired.

SUMMARY OF THE INVENTION

The present invention satisfies the need for an improved connection system by providing interconnects that can be arranged and secured in a stacked arrangement, and that can also be readily accessed and repaired.

In accordance with one aspect of the embodiments described herein, there is provided an electrical connector system with a plurality of interconnects mounted in a stacked arrangement. Each of the interconnects comprises: a connector body; a set of electrical pins extending from the connector body; a shell extending from the connector body and at least partially covering the set of connector pins; and a backshell removably coupled to the connector body, the backshell being configured to receive and retain an overbraid, cable, or the like. With respect to each interconnect of the plurality of interconnects, the backshell can be uncoupled from the connector body while retaining the plurality of interconnects in the stacked arrangement.

In accordance with another aspect of the embodiments described herein, there is provided an electrical connector apparatus comprising a plurality of interconnects in a stacked arrangement, wherein each of the interconnects comprises: a connector body; and a backshell removably coupled to the connector body, the backshell being configured to receive and retain a overbraid. With respect to at least one interconnect of the plurality of interconnects, the backshell can be uncoupled from the connector body while retaining the plurality of interconnects in the stacked arrangement.

In accordance with another aspect of the embodiments described herein, there is provided an electrical connector system comprising first and second interconnects. The first interconnect comprises a first connector body and a first backshell removably coupled to the first connector body, the first backshell being configured to receive and retain a first overbraid. The second interconnect is in a stacked arrangement with the first interconnect, and comprises a second connector body and a second backshell removably coupled to the second connector body, the second backshell being configured to receive and retain a second overbraid. The first backshell can be uncoupled from the first connector body while retaining the first and second interconnects in the stacked arrangement.

In accordance with another aspect of the embodiments described herein, there is provided an electrical connector system comprising first and second interconnects. The first interconnect comprises a first connector body and a first backshell removably coupled to the first connector body, the first backshell being configured to receive and retain a first overbraid. The second interconnect is connected with the first interconnect, and comprises a second connector body and a second backshell removably coupled to the second connector body, the second backshell being configured to receive and retain a second overbraid. The first backshell can be uncoupled from the first connector body without disconnecting the first and second interconnects.

A more complete understanding of the electrical connector apparatus and system will be afforded to those skilled in the art, as well as a realization of additional advantages and objects thereof, by a consideration of the following detailed description of the preferred embodiment. Reference will be made to the appended sheets of drawings that will first be described briefly.

DETAILED DESCRIPTION OF THE PREFERRED EMBODIMENT

The invention satisfies the need for an electrical connector system that accommodates system designs where the interconnects or connector modules need to be stacked, yet where the interconnects need to be easily accessed for repair and/or maintenance. In the detailed description that follows, like element numerals are used to describe like elements shown in one or more of the figures.

Figure 1:
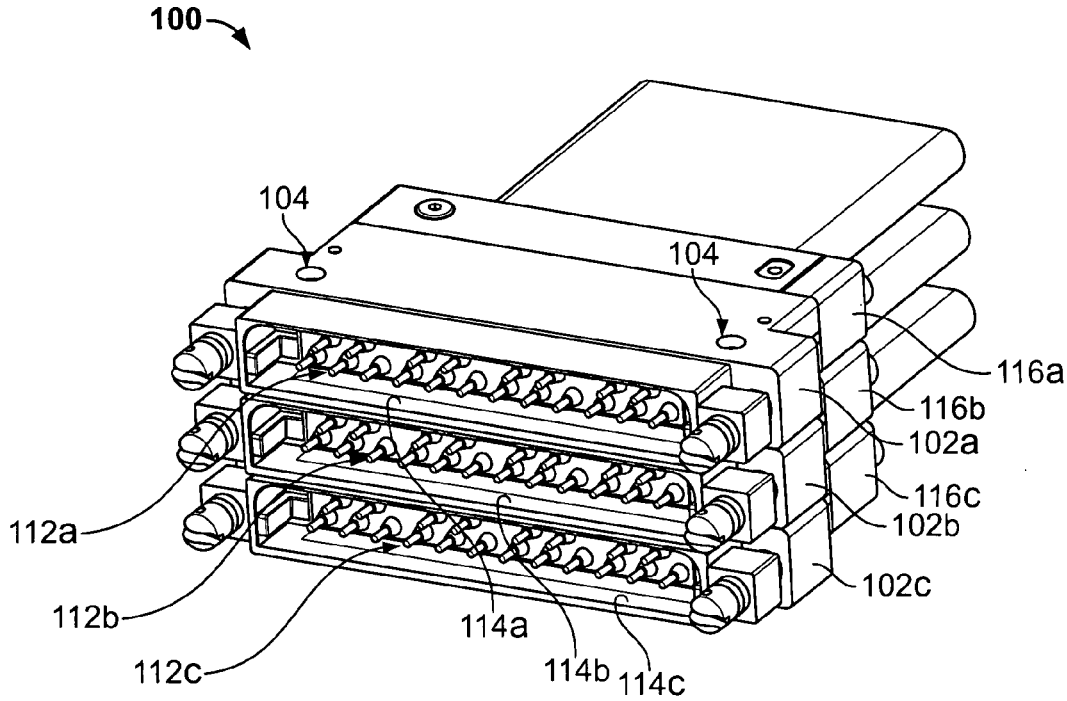
FIG. 1 is a front perspective view of an exemplary stacked arrangement of interconnects.
Figure 2:
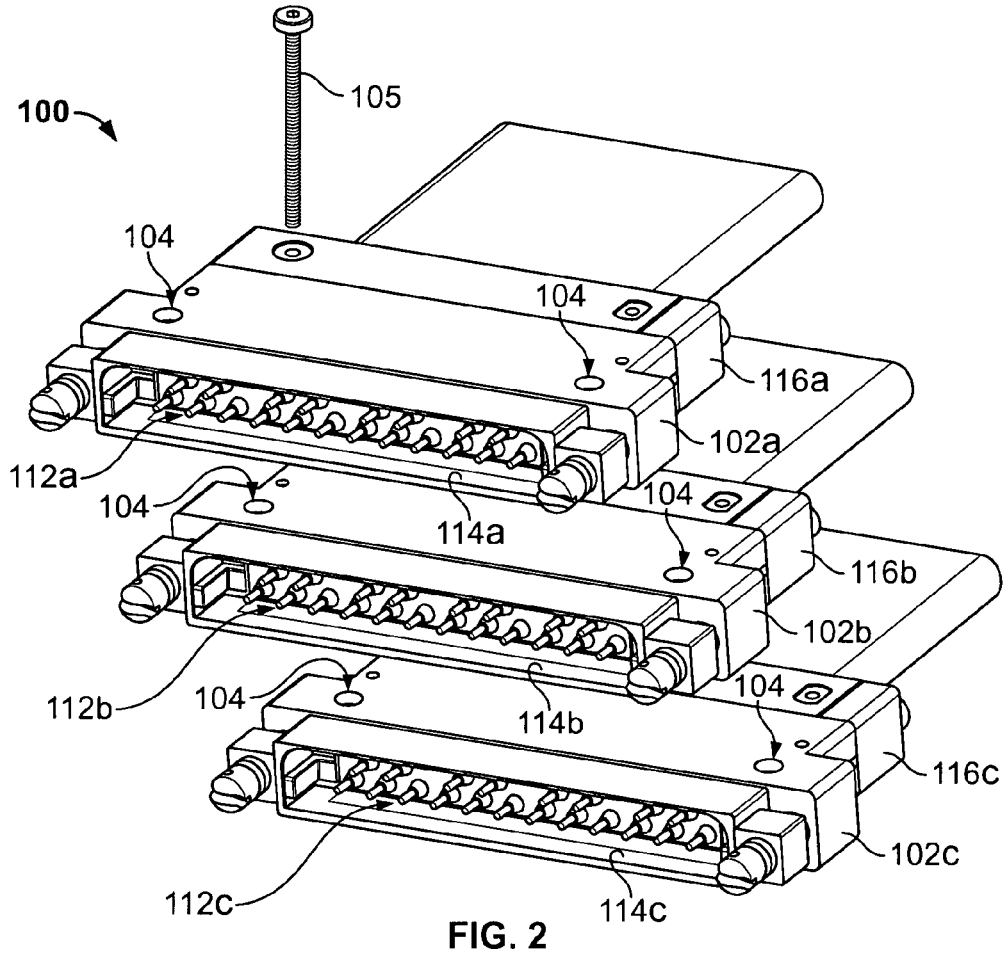
FIG. 2 is an exploded front perspective view of the exemplary stacked arrangement of FIG. 1.

With reference to the illustrative embodiment of FIGS. 1 and 2, there is provided a stacked arrangement 100 of connector modules or interconnects 102*a*, 102*b*, and 102*c*. Each module 102 has a connector body 110 and a set of connector pins or contacts 112 extending from the connector body 110. Each of the illustrated modules also has a shell 114 that extends from the connector body 110 and at least partially covers the set of contacts 112. Each module also has a backshell 116 for receiving and retaining a cable or overbraid 200. The backshell 116 is removably coupled to the connector body 110. In one embodiment, the contacts 112 extend from a front or leading portion of the connector body 110, while the backshell 116 is removably attached to a back or rear portion of the connector body 110.

Figure 3:
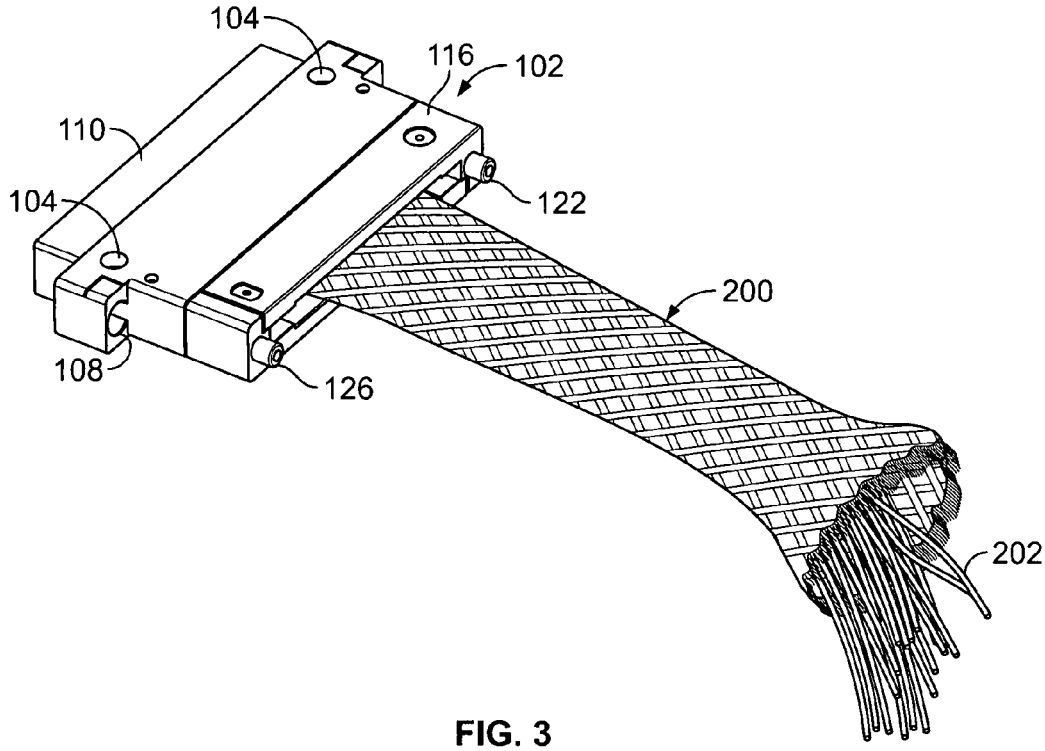
FIG. 3 is a rear perspective view of an exemplary interconnect and overbraid.

As shown in FIG. 3, each connector body 110 comprises two receiving channels 108 for receiving screws 106, such as jack screws or the like that can be used to secure the connector body 110 to the connector system or components thereof. It will be understood that any suitable number of interconnects can be provided in a stacked arrangement, depending on the particular application.

With continued reference to FIGS. 1-3, each interconnect 102 comprises two through-holes 104. Interconnects 102*a*, 102*b*, 102*c* are arranged relative to each other such that their respective through-holes 104 are aligned. The interconnects 102*a*, 102*b*, 102*c* can be mounted or fixedly held in this aligned, stacked arrangement by inserting a screw, extension, or the like through the aligned through-holes 104. The interconnects 102*a*, 102*b*, 102*c* are typically mounted or clamped to a circuit board or other components that are on or interface with the circuit board. For example, a threaded screw 105 can be used to clamp the interconnects 102*a*, 102*b*, 102*c* together and/or to a circuit board, as shown in FIG. 2. It will be understood that the interconnects 102*a*, 102*b*, 102*c* can be held in the aligned, stacked arrangement by utilizing any suitable apparatus or design known in the art. The illustrated interconnects 102*a*, 102*b*, 102*c* are modular and identical. However, it will be understood that the interconnects do not necessarily have to be modular or identical.

In accordance with one aspect of the embodiments described herein, there is provided an electrical connector system wherein the respective backshell of each interconnect is removably coupled to the respective connector body. The backshell is configured to receive and retain a overbraid. With respect to each interconnect of the plurality of interconnects, the backshell can be uncoupled from the connector body while retaining the plurality of interconnects in the stacked arrangement. As such, one or a subset of the interconnects can be accessed and repaired without disrupting the entire stacked arrangement of interconnects. For any given interconnect, the backshell can be detached from the connector body so that repairs to the components of the interconnect can be made. For example, the interface between a first overbraid and a first backshell can be made without disrupting the other interconnects of the stacked system. After the repairs are made, the backshell, along with its respective overbraid, can be reattached to its respective connector body. Accordingly, a damaged backshell can be uncoupled from its connector and repaired, while retaining the other interconnects in the stacked arrangement.

In accordance with another aspect of the embodiments described herein, there is provided an electrical connector system with interconnects that are connected to each other. For example, there is provided a first interconnect having a first connector body and a first backshell removably coupled to the first connector body. There is also provided a second interconnect that is connected with the first interconnect, and comprises a second connector body and a second backshell removably coupled to the second connector body, the second backshell being configured to receive and retain a second overbraid. The first backshell can be uncoupled from the first connector body without disconnecting the first and second interconnects.

Figure 4:
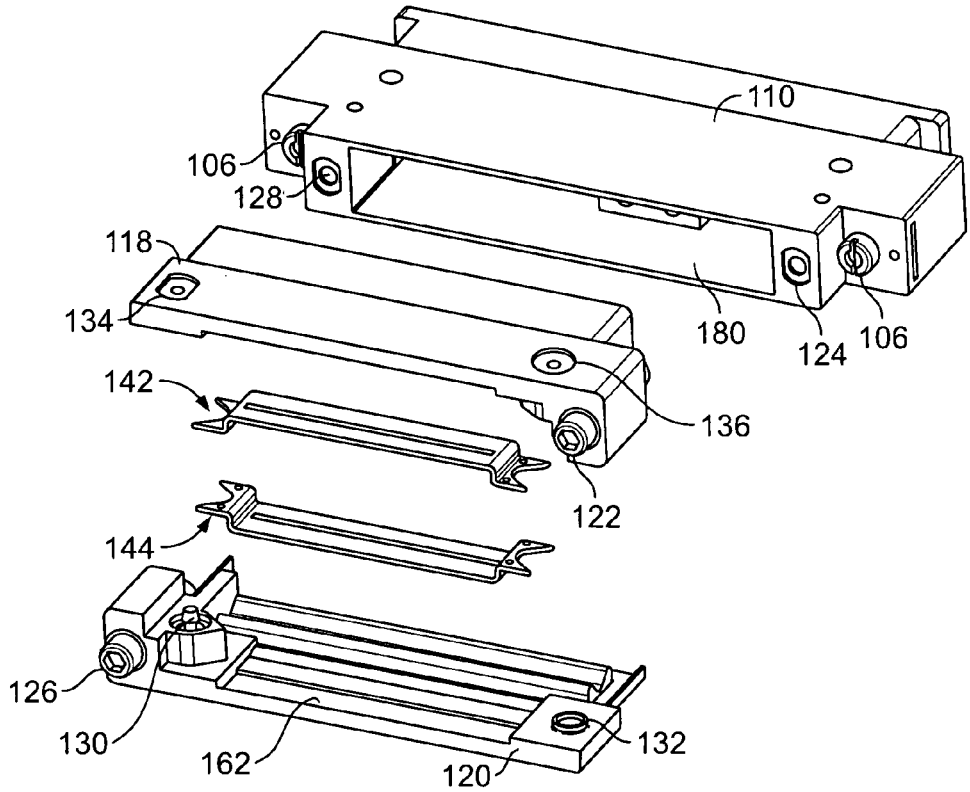
FIG. 4 is an exploded rear perspective view of components of the exemplary interconnect of FIG. 3.

In accordance with another aspect of the embodiments described herein, the interconnects can be assembled in any number of ways. With reference to FIG. 4, in one embodiment, the backshell 116 of the interconnect 102 comprises top and bottom module retainers 118, 120. The retainers 118, 120 are typically clamped onto an overbraid 200 or the like. The overbraid 200 is wrapped around braid supports 142, 144 and set in between the top and bottom retainers 118, 120. The retainers 118, 120 have corresponding mating screws 130 and receptacles 132 to clamp the retainers together. In the illustrated embodiment, the screw 130 is captivated inside the bottom module retainer 120 and can be tightened in any suitable way known in the art, such as with a standard hex key wrench or the like. For example, area 136 on a given retainer corresponds to where a wrench or the like can be used to tighten screw 130. Area 134 on a given retainer corresponds to the location of the receptacle 132 that receives the corresponding screw 130 from the opposite retainer.

Figure 6:
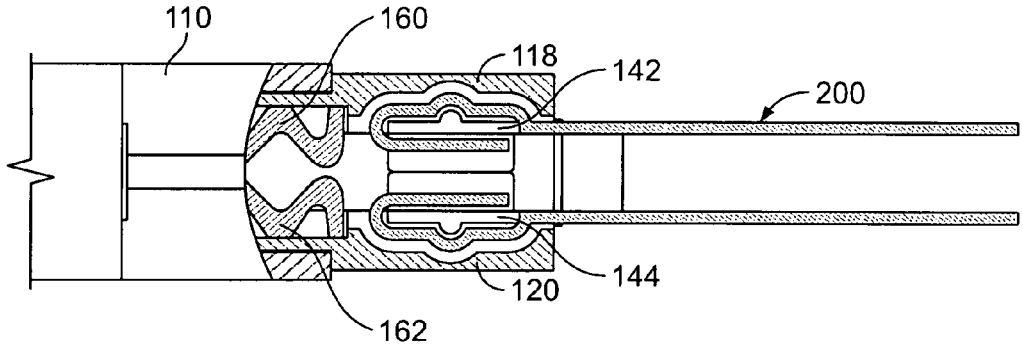
FIG. 6 is a side partial cross-sectional view of the exemplary interconnect and overbraid of FIG. 5.

When the top and bottom retainers 118, 120 are clamped together, this action clamps the overbraid 200 onto the braid supports 142, 144. The braid supports 142, 144 protect the individual wires 202 of the overbraid 200 from any clamping done onto the braid 200. The module retainers 118, 120 preferably have an attached elastomer or the like to provide strain relief and vibration dampening of the individual wires 202. Furthermore, the module retainers 118, 120 preferably have insulators 160, 162 or the like to provide a secure seal and thereby protect the inner components of the interconnect 102, as illustrated in FIG. 6.

Figure 5:
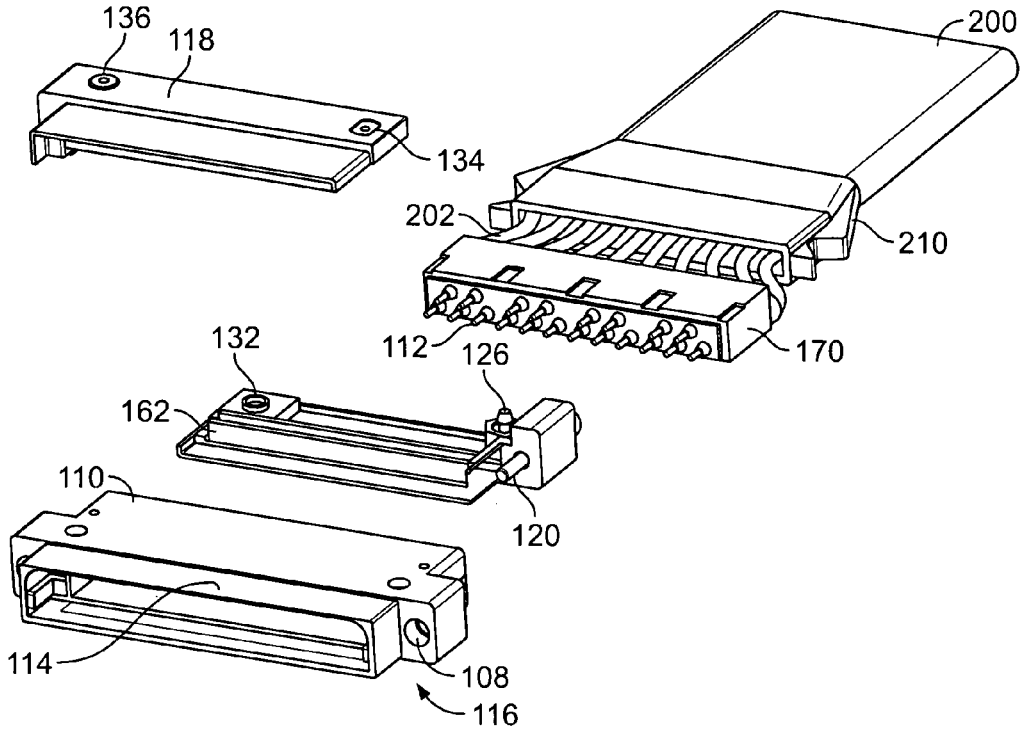
FIG. 5 is an exploded front perspective view of an embodiment of an interconnect and overbraid.

With reference to FIG. 5, the retainers 118, 120 house an insert module 170 that receives the leading ends of the wires 202 on a first, receiving end The insert module 170 comprises a set of contacts 112 on a second, leading end, wherein the contacts 112 correspond to the contacts 112 extending from the connector body 110, as described above. The leading ends of the retainers 118, 120, along with the insert module 170, are pushed into the receiving receptacle 180 of the connector body 110. The retainers 118, 120 have module retaining screws 122, 126 that mate with the receiving ends 124, 128 of the connector body 110, and thereby secure the backshell 116 to the connector body 110. When the module retaining screws 122, 126 are tightened, the insert module 170 is held securely in the forward position.

It is anticipated that the connection system of the present invention be adapted to use standard military specification contacts and insertion/removal tools. Accordingly, the present connection system would be sufficiently robust for vibration and shock, and meet the harsh environmental requirements of Mil-C-38999 or the like. In one embodiment, each of the interconnects are electrically isolated from the other, further reducing crosstalk between interconnects.

Having thus described the embodiments of an improved system of stacked interconnects, it should be apparent to those skilled in the art that certain advantages have been achieved. It should also be appreciated that various modifications, adaptations, and alternative embodiments thereof may be made within the scope and spirit of the present invention. The invention is solely defined by the following claims.

What is claimed is:

1. An electrical connector system, comprising:

a plurality of interconnects mounted together in a stacked arrangement, each of the interconnects comprising:

a connector body, comprising a front portion and a back portion;

a set of connector pins extending from the front portion of the connector body;

a backshell removably coupled to the back portion of the connector body, the backshell being configured to receive and retain an overbraid and comprising at least one aperture extending from a back side of the backshell to a front side of the backshell; and at least one screw that extends through the at least one aperture of the backshell and mates the front side of the backshell with the back portion of the connector body;

wherein, with respect to each interconnect of the plurality of interconnects, the at least one screw is configured to uncouple the backshell from the back portion of the connector body while retaining the plurality of interconnects in the stacked arrangement.

2. The system as recited in claim 1, wherein the connector body comprises at least one through-hole for mounting the plurality of interconnects together in the stacked arrangement.

3. The system as recited in claim 1, wherein at least one of the plurality of interconnects comprises a shell extending from the connector body to partially cover the set of connector pins.

4. The system as recited in claim 1, wherein the connector body comprises means for mounting the plurality of interconnects together in a stacked arrangement.

5. The system as recited in claim 1, wherein there is a one-to-one correlation between at least a subset of the set of connector pins and at least a subset of individual wires of the overbraid.

6. The system as recited in claim 1, wherein the backshell comprises a grounding backshell.

7. The system as recited in claim 1, wherein the backshell comprises a set of braid supports.

8. The system as recited in claim 7, wherein the backshell further comprises a set of retainers configured to be clamped together over the set of braid supports, thereby clamping the overbraid in between the set of braid supports.

9. The system as recited in claim 8, wherein the set of retainers comprises an elastomer for strain relief and vibration dampening of individual wires of the overbraid.

10. An electrical connector apparatus, comprising:

a plurality of interconnects oriented in a stacked arrangement, each of the interconnects comprising:

a connector body; and a backshell removably coupled to the connector body, the backshell being configured to receive and retain an overbraid and comprising at least one aperture extending from a back side of the backshell to a front side of the backshell; and at least one screw that extends through the at least one aperture of the backshell and mates the backshell with the connector body;

wherein, with respect to at least one interconnect of the plurality of interconnects, the at least one screw is configured to uncouple the backshell from the connector body while retaining the plurality of interconnects in the stacked arrangement.

11. The apparatus as recited in claim 10, wherein the connector body comprises at least one through-hole for mounting the plurality of interconnects together in the stacked arrangement.

12. The apparatus as recited in claim 10, wherein the connector body comprises means for mounting the plurality of interconnects together in a stacked arrangement.

13. The apparatus as recited in claim 10, wherein the backshell comprises a grounding backshell.

14. The apparatus as recited in claim 10, wherein the backshell comprises a set of braid supports.

15. The apparatus as recited in claim 14, wherein the backshell further comprises a set of retainers configured to be clamped together over the set of braid supports, thereby clamping the overbraid in between the set of braid supports.

16. The apparatus as recited in claim 15, wherein the set of retainers comprises an elastomer for strain relief and vibration dampening of individual wires of the overbraid.

17. The apparatus as recited in claim 10, wherein each of the interconnects further comprises a set of connector pins extending from the connector body.

18. The apparatus as recited in claim 17, wherein each of the interconnects further comprises a shell extending from the connector body and at least partially covering the set of connector pins.

19. The apparatus as recited in claim 17, wherein there is a one-to-one correlation between at least a subset of the set of connector pins and at least a subset of individual wires of the overbraid.

20. An electrical connector system, comprising:

a first interconnect, comprising:

a first connector body oriented in a first direction;

a first backshell removably coupled to the first connector body, the first backshell being configured to receive and retain a first overbraid; and at least one coupling device oriented in the first direction for coupling the first backshell with the first connector body; and a second interconnect oriented in a stacked arrangement with the first interconnect, the second connector comprising:

a second connector body oriented in the first direction;

a second backshell removably coupled to the second connector body, the second backshell being configured to receive and retain a second overbraid; and at least one other coupling device oriented in the first direction for coupling the second backshell with the second connector body;

wherein the at least one coupling device is configured to uncouple the first backshell from the first connector body while retaining the first and second interconnects in the stacked arrangement.

21. The system as recited in claim 20, wherein the second backshell can be uncoupled from the second connector body while retaining the first and second interconnects in the stacked arrangement.

22. The system as recited in claim 20, further comprising a connector third module that comprises:

a third connector body; and a third backshell removably coupled to the third connector body, the third backshell being configured to receive and retain a third overbraid.

23. The system as recited in claim 20, wherein each of the connector bodies comprises at least one through-hole for mounting the interconnects together in a stacked arrangement.

24. The system as recited in claim 20, wherein each of the connector bodies comprises means for mounting the modules together in a stacked arrangement.

25. The system as recited in claim 20, wherein the at least one coupling device comprises at least one mating screw oriented in the first direction that mates with the first connector body to removably couple the first backshell to the first connector body.

26. The system as recited in claim 20, wherein the at least one other coupling device comprises at least one mating screw for removably coupling the second backshell to the second connector body.

27. The system as recited in claim 20, wherein each of the backshells comprises a grounding backshell.

28. The system as recited in claim 20, wherein each of the interconnects further comprises a set of connector pins extending from the connector body.

29. The system as recited in claim 28, wherein each of the interconnects further comprises a shell extending from the connector body and at least partially covering the set of connector pins.

30. The system as recited in claim 20, wherein the second interconnect is connected with the first interconnect.

31. The system as recited in claim 30, wherein the first backshell can be uncoupled from the first connector body without disconnecting the first and second interconnects.

32. The system as recited in claim 20, wherein the backshell comprises a set of braid supports.

33. The system as recited in claim 32, wherein the backshell further comprises a set of retainers configured to be clamped together over the set of braid supports, thereby clamping the respective overbraid in between the set of braid supports.

34. The system as recited in claim 33, wherein the set of retainers comprises an elastomer for strain relief and vibration dampening of individual wires of the respective overbraid.

* * * * *